US007240723B2

(12) United States Patent
Wu et al.

(10) Patent No.: US 7,240,723 B2
(45) Date of Patent: Jul. 10, 2007

(54) TUBE BUNDLE HEAT EXCHANGER COMPRISING TUBES WITH EXPANDED SECTIONS

(75) Inventors: Alan K. Wu, Kitchener (CA); Michael A. Martin, Oakville (CA); Robert H. Brown, Elmvale (CA)

(73) Assignee: Dana Canada Corporation, Oakville, Ontario (CA)

( * ) Notice: Subject to any disclaimer, the term of this patent is extended or adjusted under 35 U.S.C. 154(b) by 532 days.

(21) Appl. No.: 10/778,571

(22) Filed: Feb. 13, 2004

(65) Prior Publication Data

US 2005/0067153 A1 Mar. 31, 2005

(30) Foreign Application Priority Data

Sep. 30, 2003 (CA) ..... 2443496

(51) Int. Cl.
*F28F 9/02* (2006.01)

(52) U.S. Cl. ..... 165/158; 165/159

(58) Field of Classification Search ..... 165/157, 165/158

See application file for complete search history.

(56) References Cited

U.S. PATENT DOCUMENTS

| | | | | |
|---|---|---|---|---|
| 697,560 A | | 4/1902 | Steinmetz | |
| 1,683,236 A | | 9/1928 | Braun | |
| 1,743,785 A | * | 1/1930 | Leszczyk | 165/149 |
| 1,840,510 A | | 1/1932 | Kelley | |
| 1,995,768 A | * | 3/1935 | Fesenmaier | 165/157 |
| 2,310,234 A | | 2/1943 | Haug | |
| 2,322,047 A | | 6/1943 | Mormile | |
| 2,388,721 A | * | 11/1945 | Clancy | 165/159 |
| 2,396,650 A | * | 3/1946 | Hannah | 165/148 |
| 2,424,795 A | * | 7/1947 | Burns | 165/103 |
| 2,433,546 A | * | 12/1947 | Cornelius | 156/196 |
| 2,449,922 A | * | 9/1948 | Andersen | 165/283 |
| 2,474,689 A | * | 6/1949 | Ramsaur | 165/283 |

(Continued)

FOREIGN PATENT DOCUMENTS

EP 0 772 018 B1 5/1997

OTHER PUBLICATIONS

Randy Rundle, "Automotive Cooling System Basics", Krause Publications, Inc., 1999, pp. 1-3, 18-30, 219.

(Continued)

*Primary Examiner*—Allen J. Flanigan
(74) *Attorney, Agent, or Firm*—Dykema Gossett PLLC

(57) ABSTRACT

A heat exchanger useful for high temperature applications such as EGR cooling and fuel reformer applications comprises a tube bundle made up of a plurality of tubes, each having at least one end expanded to an enlarged polygonal cross-section, and having central portions with a generally smaller cross section. When the tubes are formed into a bundle, the enlarged end portions nest with one another and interstitial spaces are provided between the central portions of the tube. The enlarged end portions are preferably retained by a header ring having a multifaceted inner peripheral sidewall which is adapted to form brazed lap joints with the outward facing surfaces of the peripheral tubes end portions in the tube bundle. In one preferred arrangement, axially aligned enlarged portions are provided intermediate the ends of at least some of the tubes. These enlarged intermediate portions nest with one another and eliminate or reduce the need for baffle plates.

39 Claims, 12 Drawing Sheets

U.S. PATENT DOCUMENTS

| | | | | | |
|---|---|---|---|---|---|
| 2,505,695 | A | | 4/1950 | Villiger et al. | |
| 2,568,984 | A | * | 9/1951 | Bowsher | 165/148 |
| 2,577,123 | A | * | 12/1951 | Hitchens et al. | 29/890.043 |
| 2,577,124 | A | * | 12/1951 | Newcomer | 28/890.044 |
| 2,793,835 | A | | 5/1957 | Woods | |
| 2,803,440 | A | | 8/1957 | Simpelaar | |
| 3,297,081 | A | * | 1/1967 | Nunemaker | 165/159 |
| 3,782,457 | A | | 1/1974 | Troy | |
| 4,750,553 | A | | 6/1988 | Pohl et al. | |
| 4,750,554 | A | | 6/1988 | Oeij et al. | |
| 5,258,165 | A | | 11/1993 | Olsen | |
| 5,318,113 | A | | 6/1994 | Potier | |
| 5,323,849 | A | * | 6/1994 | Korczynsk et al. | 165/158 |
| 5,431,218 | A | | 7/1995 | Lelievre | |
| 5,517,828 | A | | 5/1996 | Calton et al. | |
| 5,551,245 | A | | 9/1996 | Calton et al. | |
| 5,579,832 | A | | 12/1996 | Le Gauyer | |
| 5,699,395 | A | * | 12/1997 | Sylvester et al. | 376/405 |
| 5,821,390 | A | * | 10/1998 | Ruppel et al. | 568/470 |
| 5,901,784 | A | | 5/1999 | Potier | |
| 5,915,472 | A | | 6/1999 | Takikawa et al. | |
| 6,012,512 | A | | 1/2000 | Ghiani | |
| 6,044,554 | A | | 4/2000 | Potier | |
| 6,068,050 | A | | 5/2000 | Ghiani | |
| 6,105,665 | A | | 8/2000 | Ghiani | |
| 6,213,105 | B1 | | 4/2001 | Banzhaf et al. | |
| 6,269,870 | B1 | | 8/2001 | Banzhaf et al. | |
| 6,293,334 | B1 | | 9/2001 | Ghiani | |
| 6,321,835 | B1 | | 11/2001 | Damsohn et al. | |
| 6,397,937 | B1 | | 6/2002 | Ghiani | |

OTHER PUBLICATIONS

Youitsu, Kakoi, et al. "Emission Reduction Technologies Applied to High-Speed Direct Injection Diesel Engine" SAE Paper No. 980173, 1998, pp. 1-7.

Arcoumanis, C., et al. "Effect of EGR on Combustion Development in a 1.9L DI Diesel Optical Engine" SAE Paper No. 950850, 1995, pp. 169-193.

Leet, Jeffrey A., et al. "EGR's Effect on Oil Degradation and Intake System Performance" SAE Paper No. 980179, 1998.

* cited by examiner

FIG. 8.
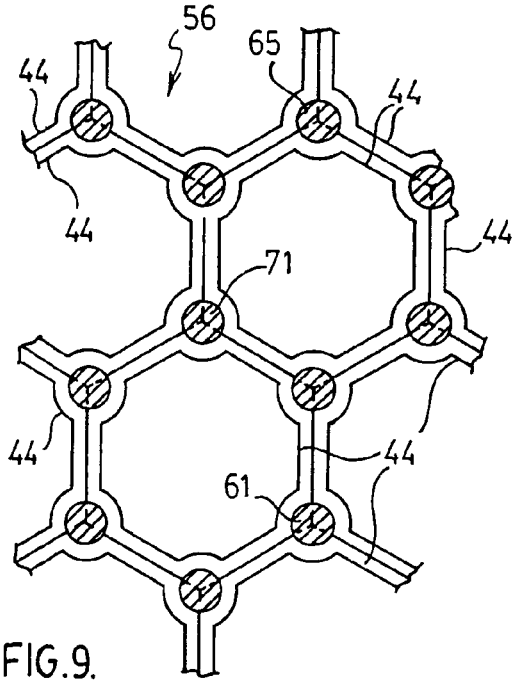
FIG. 4.
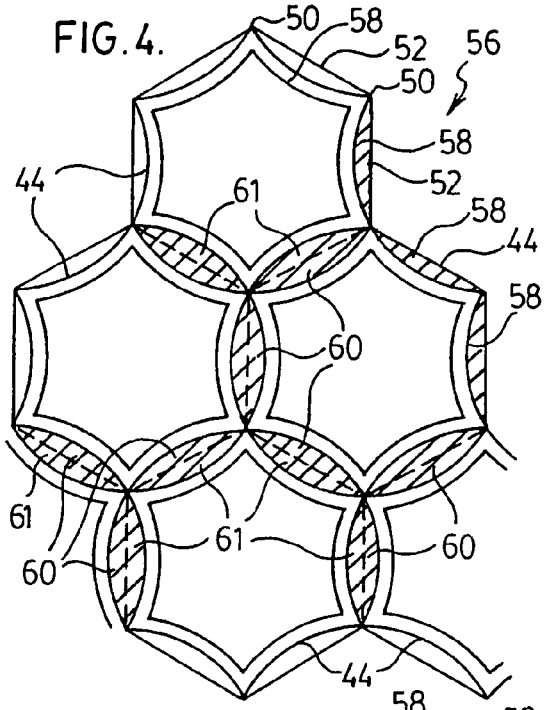
FIG. 9.
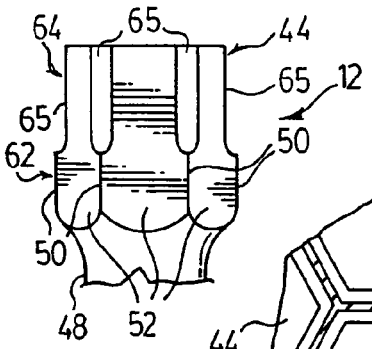
FIG. 5.
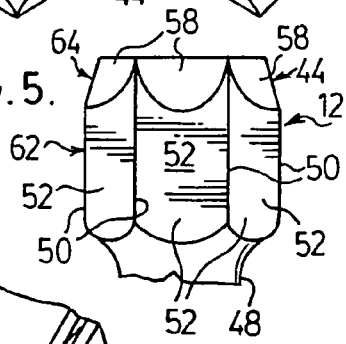
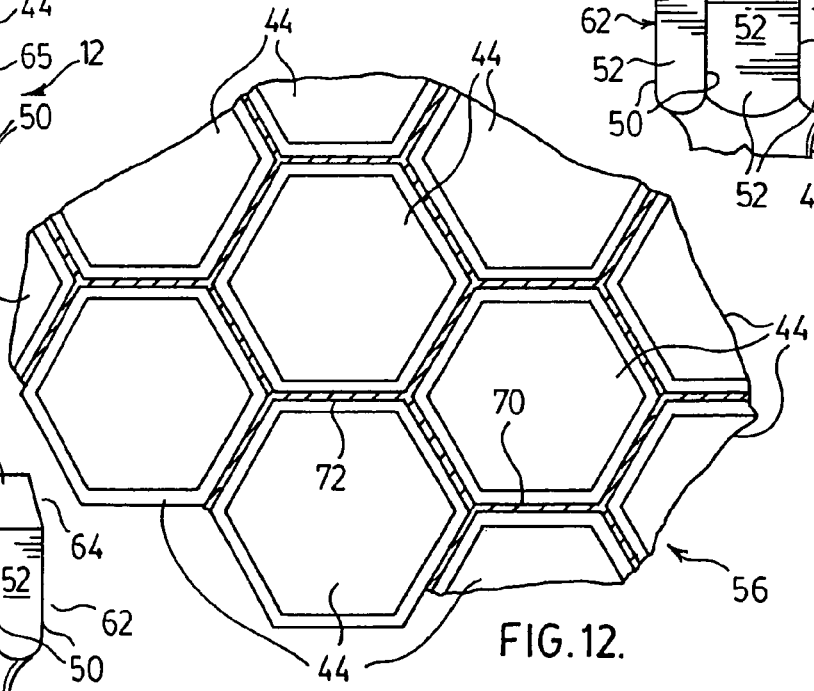
FIG. 12.
FIG. 13.
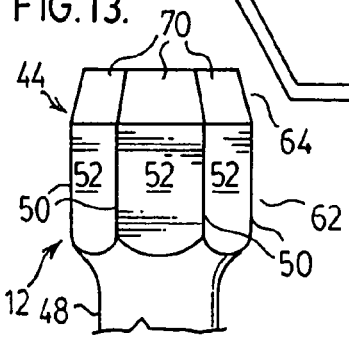

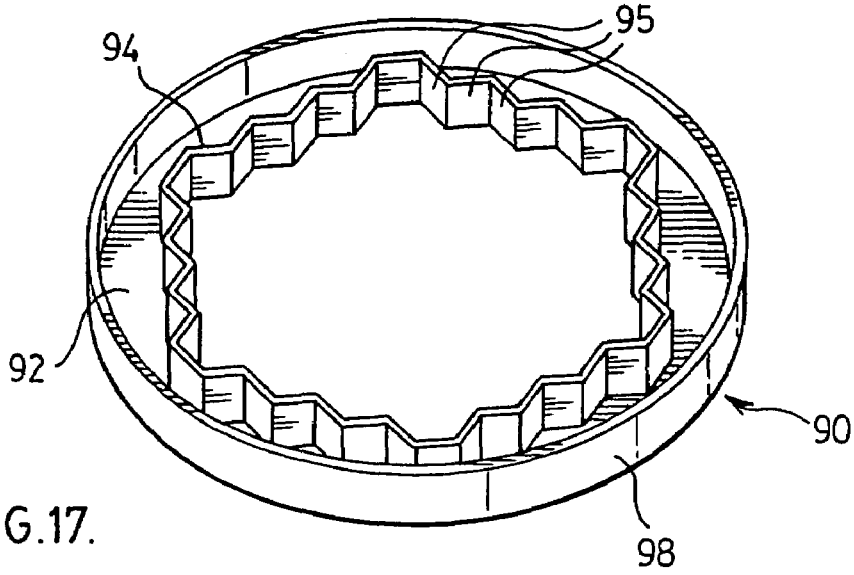
FIG.17.
FIG.18.
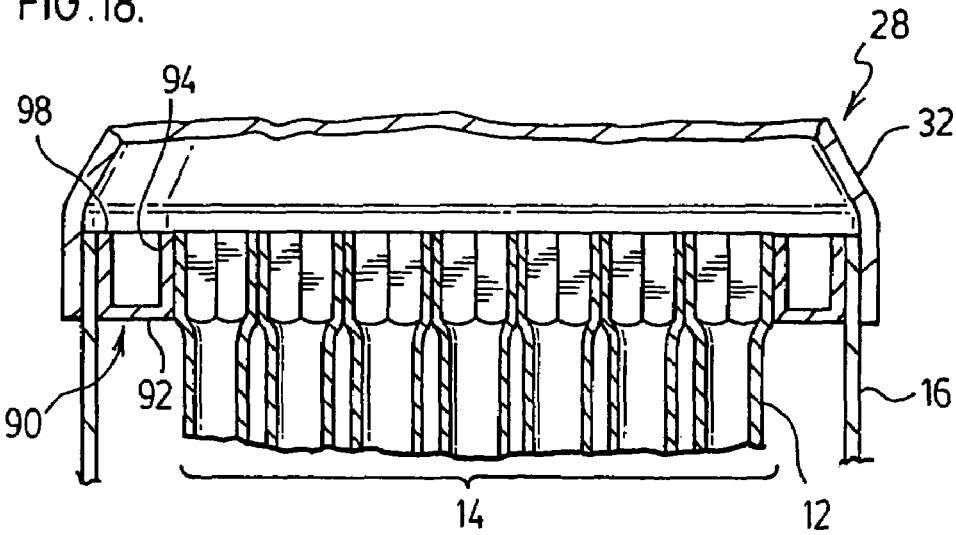

TUBE BUNDLE HEAT EXCHANGER COMPRISING TUBES WITH EXPANDED SECTIONS

This application claims priority to Canadian Patent Application No. 2,443,496 filed Sep. 30, 2003.

FIELD OF THE INVENTION

This invention relates to heat exchangers of the type which comprise a bundle of spaced, parallel tubes and more particularly to such heat exchangers having tubes with expanded sections which permit the elimination of conventional headers and/or baffle plates.

BACKGROUND OF THE INVENTION

Tube bundle heat exchangers are used in a number of applications, and have been extensively used in automotive applications. Such heat exchangers typically comprise a bundle of spaced, parallel tubes enclosed in a housing or shell. A first heat exchange fluid flows through the tubes, while a second heat exchange fluid flows through the housing and passes through the interstitial spaces between the outer surfaces of the tubes.

In a typical construction of a tube bundle heat exchanger, parallel tubes of circular cross-section are retained in place at their ends by perforated header plates, also known as tube sheets. In addition to retaining the tubes, the header plates also provide a seal to prevent flow communication between the tube interiors and the interior of the housing. The seal between the tubes and the header plate is usually provided by welded or brazed butt joints between the side surfaces of the tubes and the peripheral edges of the perforations in the tube sheet. Similarly, the header plate is sealed to the inner surface of the shell by a welded or brazed butt joint. Such joints provide a relatively small sealing surface and are prone to stress-induced failure. High stresses caused by thermal cycling effects are of particular concern in high temperature heat exchangers such as exhaust gas recirculation (EGR) coolers and fuel reformer heat exchange devices.

The incidence of stress-induced failure can be reduced by increasing the thickness of the header plate, thereby increasing the surface areas of the joints between the header plate and the tubes and between the header plate and the shell. However, increasing the thickness of the header plate by a significant amount adds to the material cost and significantly increases the cost of tooling and the complexity of forming the holes in the header plate.

Furthermore, one of the performance-driven goals of heat exchanger design is the reduction of tube diameters to increase fluid flow rates and heat transfer rates. However, conventional tube bundle heat exchangers cannot easily accommodate small diameter tubes due to the complexity of stamping small-diameter holes, and the compounding difficulty of forming the holes in thicker header plate constructions.

It is known to construct tube bundle heat exchangers without conventional header plates. For example, header plates can be eliminated by providing tubes with expanded ends shaped to directly engage and nest with one another while maintaining the central portions of the tubes in parallel, spaced relation to one another. Examples of this type of heat exchanger are cellular-type radiators of the type used in early automobiles and airplanes, and as described in Chapter 4 of "Automotive Cooling System Basics" by Randy Rundle, Krause Publications, 1999, pages 18 to 30. In cellular-type radiators, the ends are expanded to a shape which permits the tubes to be nested together. In use, air passes through the horizontal tubes and engine coolant flows down and around on the outsides of the tubes.

An exhaust gas cooler having a tube bundle comprising rectangular tubes with expanded ends is described in U.S. Pat. No. 6,321,835 to Damsohn et al. As shown in FIG. 1 of Damsohn et al., the expanded tube ends are connected to one another and to the heat exchanger shell. Although Damsohn et al. avoids use of perforated headers, it requires that the shell be formed with a complex shape for joining directly to the irregularly shaped tube bundle.

There is a need for improved constructions for tube bundle heat exchangers which preferably avoid the use of conventional, perforated header plates and/or conventional baffle plates.

SUMMARY OF THE INVENTION

In one aspect, the present invention provides a heat exchanger comprising a plurality of tubes extending in parallel relation to one another and defining a tube axis. Each of the tubes comprises a pair of open ends, a tube wall extending between the ends and defining a hollow interior, a portion having an enlarged cross-sectional area and a portion having a relatively smaller cross-sectional area, both the enlarged portion and the smaller portion extending parallel to the tube axis. The enlarged portion of each of the tubes has a cross-sectional shape comprising a plurality of corners and a plurality of side surfaces extending between the corners, the side surfaces being generally parallel to the tube axis. The tubes are arranged as a tube bundle in which a first plurality of the tubes comprise inner tubes and a second plurality of the tubes comprise outer tubes, the outer tubes being located on a periphery of the tube bundle. The enlarged portion of each of the tubes abuts the enlarged portion of at least one other tube, the enlarged portions being in abutment with one another along their side surfaces, with sealed connections being provided between abutting pairs of the side surfaces to prevent axial flow of a fluid between the abutting side surfaces, and with interstitial spaces being formed between the smaller portions of adjacent tubes. The enlarged portion of each of the inner tubes abuts the enlarged portions of adjacent tubes along all of its side surfaces, with at least one side surface of the enlarged portion of each outer tube facing generally radially outwardly and not being connected to the side surface of the enlarged portion of an adjacent tube, the radially outwardly facing surfaces defining the periphery of the tube bundle. The heat exchanger further comprises an annular header ring extending about the periphery of the tube bundle which is connected to the enlarged portions of the outer tubes.

In another aspect, the present invention provides a method for manufacturing a heat exchanger. The method comprises providing a plurality of tubes, each of which comprises a tube wall and a hollow interior defined by the tube wall. Each tube has opposite end portions of enlarged cross-sectional area and a central portion of relatively smaller cross-sectional area, the enlarged portions and the central portion being concentric, each of the end portions having a cross-sectional shape comprising a plurality of corners and a plurality of side surfaces extending between the corners, the end portions of at least some of the tubes being provided with indentations in at least some of the side surfaces. The method further comprises forming the tubes into a tube bundle in which the tubes are in parallel relation to one another and define a tube axis. The side surfaces of the end portions and the central portions extend parallel to the tube axis, each of the tubes in the bundle being arranged to have its end portions abutting the end portion of at least one other of the tubes and its central portion spaced from the central portions of the other tubes in the bundle. The end portions abut one another along their side surfaces to form a plurality of facing pairs of side surfaces, and the indentations in the side surfaces of the end portions form voids between the facing pairs of side surfaces. The method further comprises at least partially filling each of the voids with a filler metal-forming material, the filler metal-forming material being sufficient to form a sealed connection between each facing pair of the side surfaces. The method further comprises heating the tube bundle to a sufficient temperature and for a sufficient time to cause the filler metal-forming material to liquefy and form a filler metal, the filler metal flowing into areas between the facing pairs of side surfaces. Lastly, the method comprises cooling the tube bundle to solidify the filler metal and thereby form a sealed connection between each of the facing pairs of side surfaces.

BRIEF DESCRIPTION OF THE DRAWINGS

The invention will now be described, by way of example only, with reference to the accompanying drawings, in which:

FIG. 4 illustrates a tube bundle in which a first preferred form of indentation is provided in the expanded tube end portions;

FIG. 5 is a side view of a tube having end portions indented as in FIG. 4;

FIG. 8 illustrates a tube bundle in which a third preferred form of indentation is provided in the expanded tube end portions;

FIG. 9 is a side view of a tube having end portions indented as in FIG. 8;

FIG. 12 illustrates a tube bundle in which a fifth preferred form of indentation is provided in the expanded tube end portions;

FIG. 13 is a side view of a tube having end portions indented as in FIG. 12;

FIG. 17 is a perspective view of a second preferred header ring according to the invention, shown in spaced relation to a bundle of tubes having expanded, hexagonal end portions;

FIG. 18 is a cross-sectional side view showing a portion of a heat exchanger including the header ring according to FIG. 17;

DETAILED DESCRIPTION OF PREFERRED EMBODIMENTS

Figure 1:
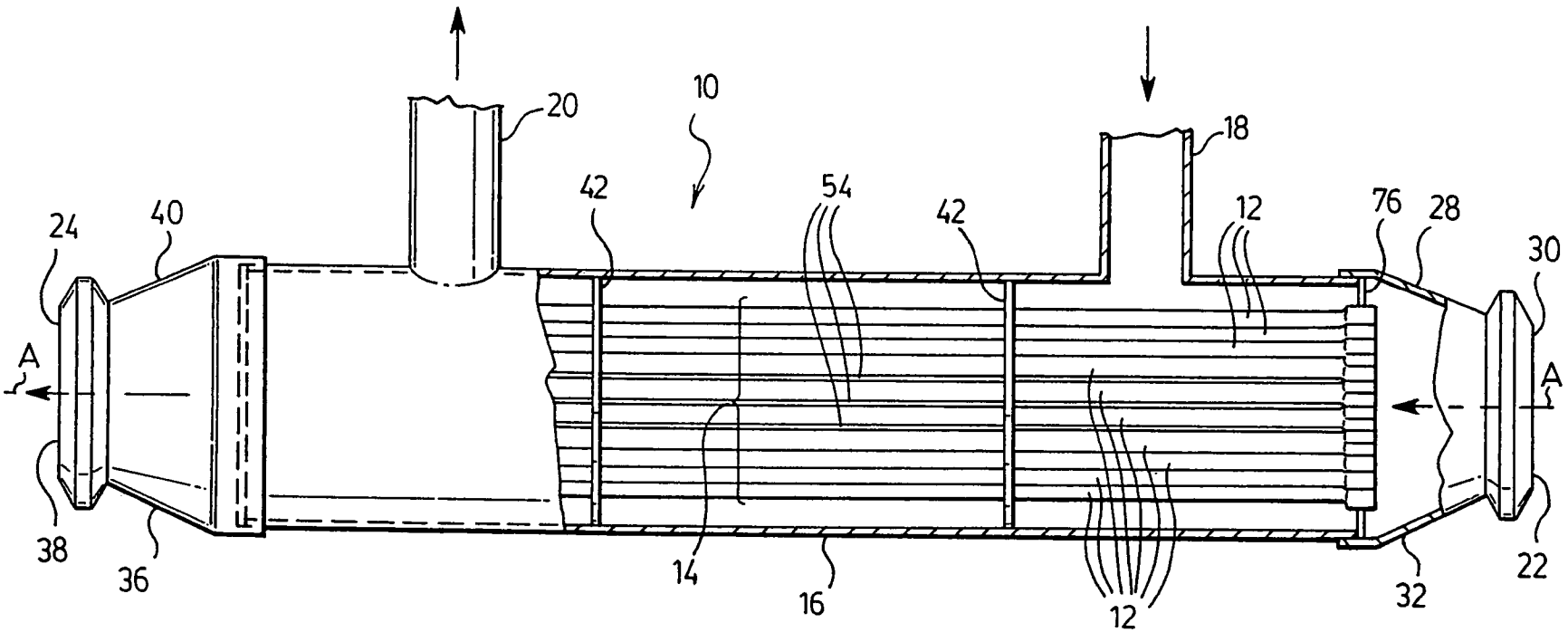
FIG. 1 is a side view, partly in cross-section, showing a preferred heat exchanger according to the present invention.

FIG. 1 illustrates a preferred heat exchanger 10 according to a first preferred embodiment of the invention. Heat exchanger 10 is particularly suited for use as a high temperature heat exchanger of the type where stress-induced failure of header plate joints would be of concern. For example, heat exchanger 10 can be used as an EGR cooler. It will also be appreciated that heat exchanger 10 may be adapted for use in a number of other automotive or non-automotive applications, including application to fuel cell fuel processors and fuel reformers.

The heat exchanger 10 comprises a plurality of tubes 12 extending parallel to one another and defining a tube axis A. The tubes are arranged in the form of a tube bundle 14 which is more particularly described below with reference to FIGS. 3A and 3B. The tube bundle 14 is enclosed along, its sides by an axially extending outer shell or housing 16. The housing 16 is provided with a first inlet port 18 and a first outlet port 20 to permit a first heat exchange fluid to flow through the interior of housing 16 in contact with the exterior surfaces of tubes 12.

The heat exchanger 10 also has a second inlet port 22 and a second outlet port 24, the second inlet and outlet 22, 24 being in fluid communication with the hollow interiors 26 (FIG. 2) of tubes 12. In use, a second heat exchange fluid flows through the interiors 26 of tubes 12 between the second inlet port 22 and the second outlet port 24, the second fluid being in heat exchange communication with the first fluid flowing within the housing 16. Where the heat exchanger 10 is an EGR cooler, the first heat exchange fluid comprises a liquid coolant and the second heat exchange fluid comprises hot exhaust gases which are cooled by heat exchange with the liquid coolant as they pass through the tubes 12.

In preferred heat exchanger 10, the second inlet port 22 is in the form of an inlet cap 28 having a circular inlet opening 30 and a conical side wall 32 which ensures a substantially even distribution of the second heat exchange fluid into tubes 12 of the tube bundle 14. Similarly, second outlet port 24 is in the form of an outlet cap 36, comprising a circular outlet opening 38 and a conical side wall 40. Both the inlet and outlet caps 28, 36 are sealed to the ends of housing 16, for example by brazing.

As will be explained in detail below, the heat exchanger further comprises a pair of header rings 76 (only one of which is shown in FIG. 1) which retain the tubes 12 in relation to one another and seal the heat exchanger 10 against fluid communication between the tube interiors 26 and the interior of housing 16.

The heat exchanger 10 may further comprise one or more baffle plates 42 which maintain proper spacing between the tubes 12 and also guide the flow of the first heat exchange fluid within housing 16. Preferred heat exchanger 10 is shown as having two baffle plates 42, each of which is annular in construction, having a central opening (not shown) through which the first heat exchange fluid is directed, thereby guiding the flow of fluid away from the housing and radially inwardly into intimate contact with the exterior surfaces of the tubes 12. A brazed joint may preferably be formed between the outer peripheral edge of each baffle plates 42 and the inner surface of housing 16. Although preferred heat exchanger 10 comprises baffle plates 42, it will be appreciated that baffle plates are not an essential component of heat exchangers of the invention. It will also be appreciated that the baffle plates 42 may be of alternate construction. For example, the baffle plates may be perforated and may be of a shape other than annular, for example they may be semi-circular.

The structures of heat exchange tubes 12 and the tube bundle 14 are now described in detail with reference to FIGS. 2, 3A and 3B.

Figure 2:
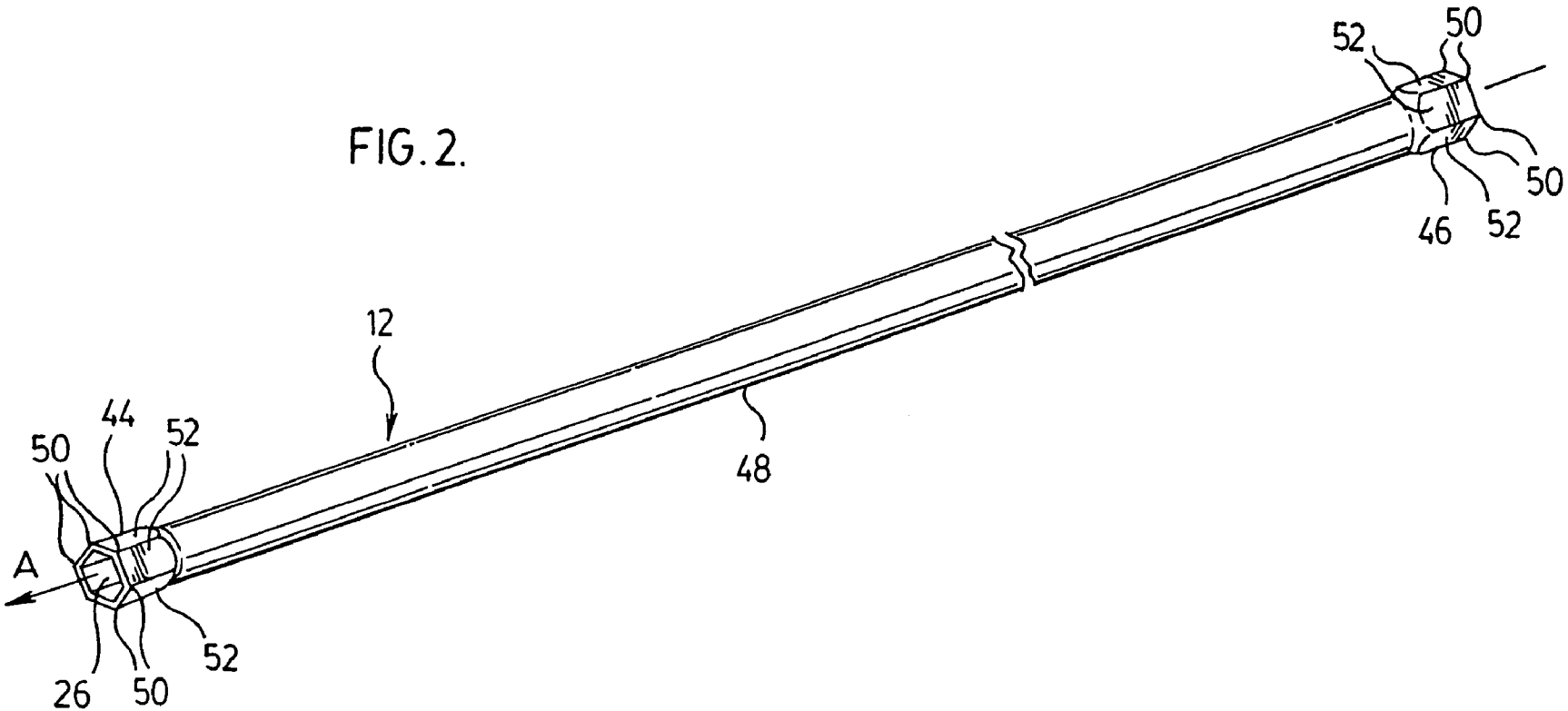
FIG. 2 is an isolated perspective view of a heat exchanger tube for use in the heat exchanger of FIG. 1.

As shown in FIG. 2, each of the tubes 12 comprises a first end portion 44, an opposite second end portion 46 and a central portion 48. The tube end portions 44, 46 and the central portion 48 extend parallel to the tube axis A and are concentric with each other to define a continuous hollow interior space 26 of the tube 12. The end portions 44, 46 each have a plurality of corners 50 and a plurality of side surfaces 52 extending between the corners 50. The side surfaces 52 are generally parallel to the tube axis A. Preferably, the end portions 44,46 are of a generally polygonal cross-section. In the preferred embodiment shown in the drawings, the tube end portions 44, 46 have a generally hexagonal cross-section. However, it will be appreciated that other polygonal shapes may instead be used, that the first and second end portions need not necessarily have the same polygonal shape, and that it may be preferred to only provide a polygonal shape at one end of the tube. The cross-sectional shape of either or both of the tube end portions 44, 46 may be selected from the group comprising triangular, square, rectangular, pentagonal, hexagonal, heptagonal, octagonal, or any other suitable polygonal shape. The central portions 48 of the tubes 12 preferably have a circular cross-section, although the central portion 48 may have other cross-sectional shapes along part or all of its length.

The tube end portions 44, 46 are preferably formed by expanding and shaping the ends of a cylindrical tube with a suitable tool. As a result, the tube end portions 44, 46 each have a cross-sectional area greater than that of the central portion 48. Thus, when the tubes 12 are arranged in a bundle as shown in FIG. 3, with the side surfaces 52 of adjacent tubes 12 in abutment, interstitial spaces 54 are formed between the central portions 48 of adjacent tubes 12, providing for circulation of the second heat exchange fluid over the outer surfaces of all the tubes 12 in the tube bundle 14.

The particular arrangement of the tube end portions 44, 46 in the tube bundle is now described in detail below with reference to FIG. 3A.

As mentioned above, the end portions 44 and 46 of tubes 12 contained in tube bundle 14 abut one another along their side surfaces. In particular, the first end portion 44 of each tube abuts the first end portion 44 of at least one other tube 12 in the tube bundle 14. Similarly, the second end portion 46 of each tube 12 abuts the second end portion 46 of at least one other tube 12. In the preferred tube bundle 14 shown in FIG. 3, the second ends 46 of tubes 12 are shown as being in abutment with one another.

The tubes 12*a* located on the periphery of the tube bundle 14 (also referred to as "outer tubes"), only some of which are labelled, have at least one side surface 52 generally facing in a radially outward direction and not being connected to the side surface 52 of an adjacent tube end portion 46. In the preferred embodiment shown in the drawings, in which the tube end portions 44, 46 are hexagonal, each of the outer tubes 12*a* has either two or three radially outwardly facing side surfaces 52, with the remaining side surfaces 52 being connected to side surfaces 52 of adjacent tubes 12.

The tube bundle also includes a second plurality of tubes 12*b* (also referred to as "inner tubes"), only some of which are labelled. The inner tubes 12*b* are completely surrounded by the outer tubes 12*a*, and each of the side surfaces of the inner tube end portions 46 are connected to a side surface 52 of an adjacent tube end portion 46. In the preferred embodiment shown in FIG. 3, the tube bundle 14 comprises 37 tubes 12, 18 of which are outer tubes 12*a*, and 19 of which are inner tubes 12*b*.

The tubes 12 may preferably all have the same length, their end portions lining up in a plane perpendicular to the tube axis A, thus forming a planar end face 56 at each end of the tube bundle 14. When the tubes 12 are lined up and bundled as in FIG. 3A, each of the side surfaces of inner tubes 12*b*, and some of the side surfaces of outer tubes 12*a*, are paired with a side surface 52 of an adjacent tube end portion 44, 46, with the paired side surfaces 52 being co-extensive. As used herein, the term co-extensive means that the boundaries of the side surfaces extend over the same spatial area.

It will, however, be appreciated that heat exchangers according to the invention could be constructed with tubes of the same or different length in which the end portions are staggered relative to one another. Such an embodiment is illustrated in FIG. 3B, showing in isolation the end face 56 of a tube bundle 14, in which the end portions of tubes 12 are retained by an annular header ring 76. The tubes 12 in tube bundle 14 are arranged as a series of concentric rings staggered relative to one another so as to have alternating height relative to the header ring 76. The outer tubes 12*a* (only some of which are labelled) have end faces which are coplanar to one another and which are staggered relative to a first ring of inner tubes 12*b* (only some of which are labelled) with which they are in direct contact. The first ring of inner tubes 12*b* have coplanar end faces and are staggered relative to a second ring of inner tubes 12*b*' (only some of which are labelled) with which they are in direct contact. The tubes 12*b*' of the second ring have coplanar end faces which are staggered relative to a central tube 12*b*". This arrangement is advantageous where the heat exchanger components are joined by brazing, since it permits precise placement of sufficient filler metal-forming material at the joints between the tubes 12. For example, a filler metal-containing material coated on the tube ends would at least partially coat the exposed side surfaces of the tube ends, and would flow by capillary action into the joints between the tubes during brazing. It will be appreciated that numerous other staggered arrangements of tubes 12 are possible.

Figure 3A:
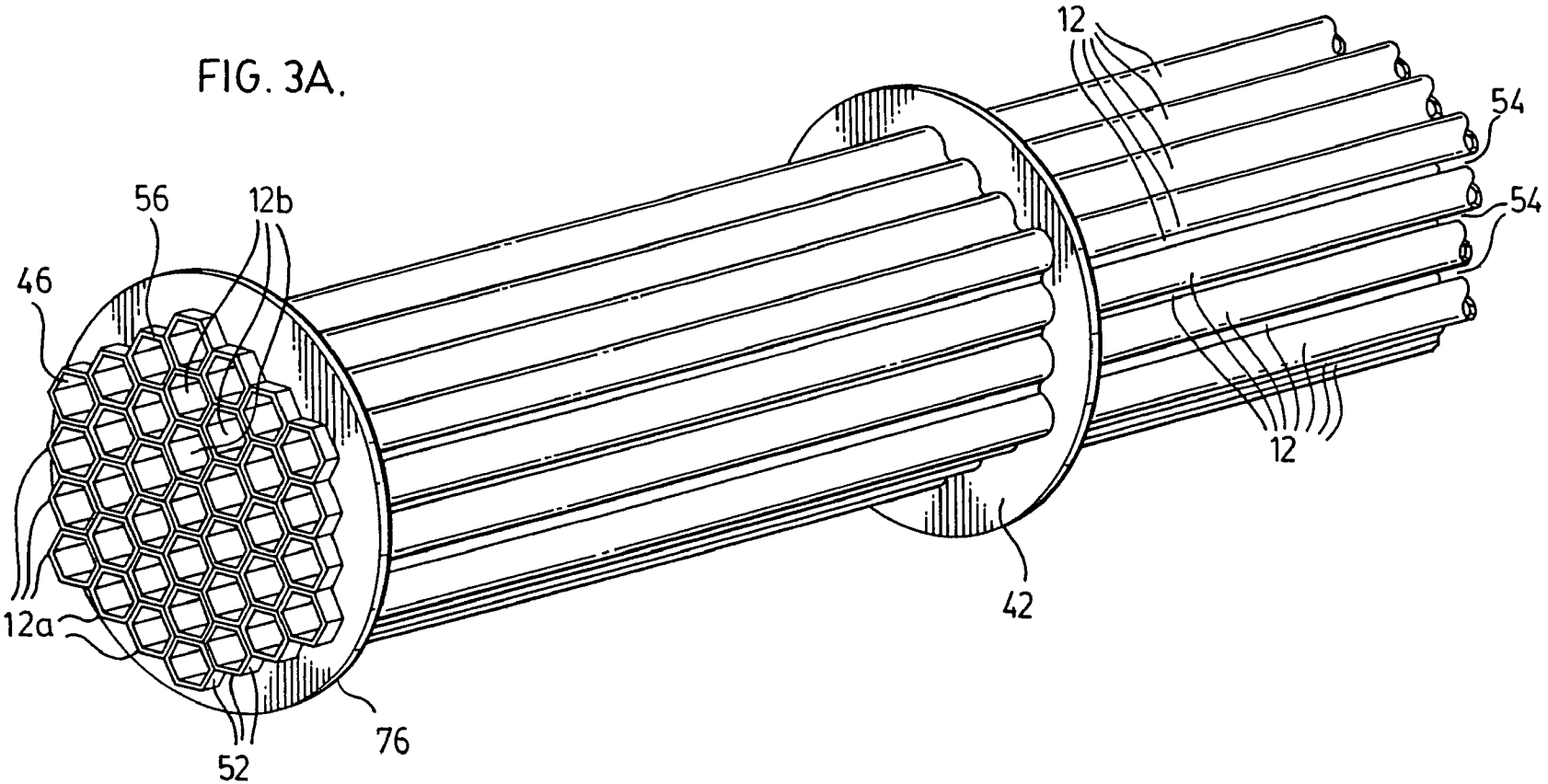
FIG. 3A is an isolated view of the tube bundle of the heat exchanger shown in FIG. 1, showing the arrangement of tube end portions at the outlet end of the heat exchanger.
Figure 3B:
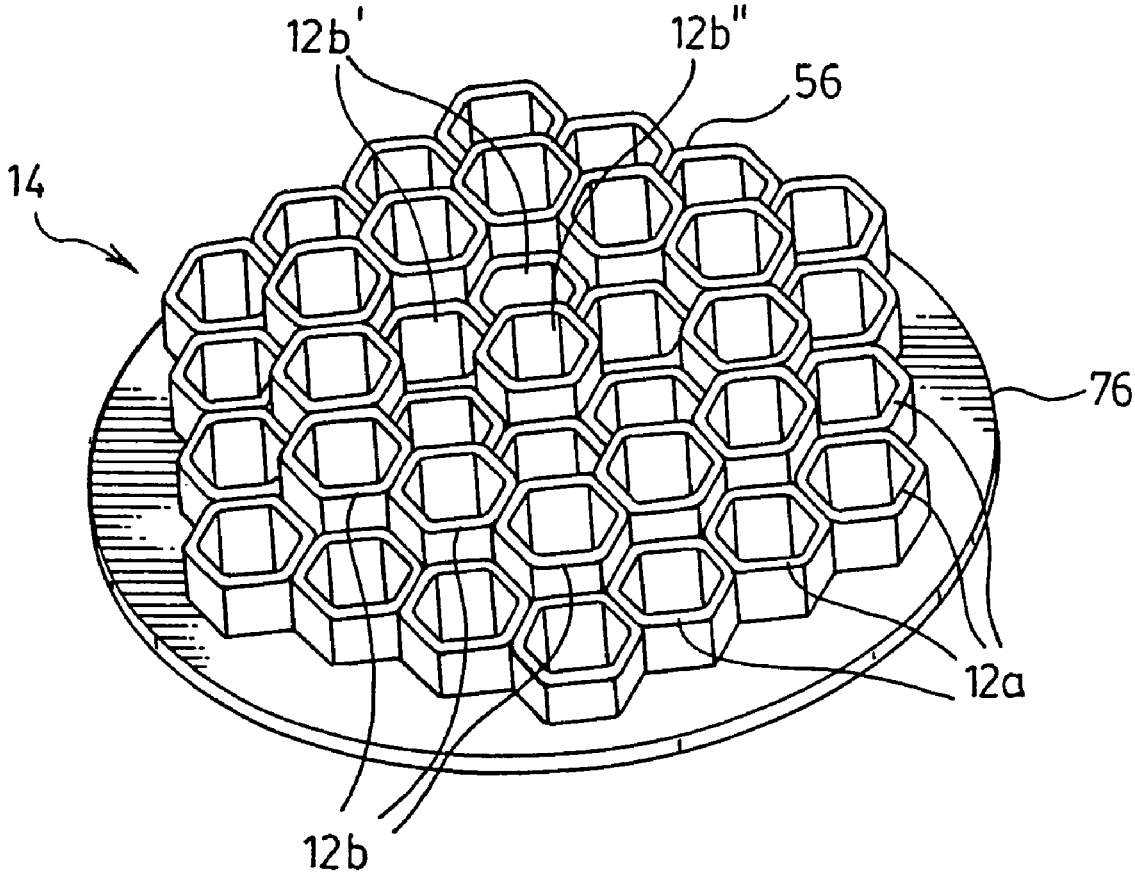
FIG. 3B is an isolated view of an alternate, staggered arrangement of the tube end portions.

By expanding the end portions 44, 46 of tubes 12 to a polygonal shape, the tubes can be retained in a tube bundle 14 as shown in FIGS. 3A and 3B without the need for a conventional header plate or tube sheet as described above in the context of the prior art. It will also be appreciated that the joints formed between each pair of abutting side surfaces 52 is similar to a lap joint, having a relatively large brazing surface compared to a butt joint such as that formed between the tubes and the header of a conventional tube bundle heat exchanger.

As mentioned above, brazed heat exchangers require a filler metal to form joints between the side surfaces 52 of tube end portions 44, 46. It will also be appreciated that, when the tubes 12 are formed into a tube bundle 14 having a planar end face 56 as shown in FIG. 3A, it may be difficult to introduce a filler metal-forming material between abutting side surfaces 52 of the tube end portions 44, 46. In one preferred aspect, the present invention provides indentations in the end portions of at least some of the tubes 12, these indentations forming voids in the joints between the side surfaces 52 into which a filler metal-forming material may be introduced. The term "indentation" as used herein refers to any portion of the tube end portion 44, 46 which extends radially inwardly toward the center of the tube 12 and which forms a void between abutting side surfaces 52, the void being accessible to introduction of a filler metal-forming material from the end face 56 of the tube bundle 14. Six preferred types of indentations are now described below with reference to FIGS. 4 to 15.

FIGS. 4, 6, 8, 10, 12 and 14 are end views of a tube bundle 14, showing the end face 56 made up of the first end portions 44 of the tubes 12. It will be appreciated that the opposite planar end face 56, made up of the second end portions 46 of tubes 12, will be of similar or identical appearance. FIGS. 5, 7, 9, 11, 13 and 15 are side views of one of the tubes 12 making up the tube bundles of FIG. 4, 6, 8, 10, 12 and 14, respectively.

In FIGS. 4 and 5, the tube end portions 44 have a generally hexagonal cross-section, having six side surfaces 52 and six corners 50 (not all labelled). In the tubes 12 of FIG. 4, each side surface 52 is deformed concavely between its corners 50, thus forming an arc-shaped indentation 58. The indentations 58 of abutting side surfaces 52 communicate with one another to form voids 60 into which a filler metal-forming material 61 can be introduced.

As shown in FIG. 5, the tube end portions 44 each have an axially inner end portion 62 which is proximate to the central portion 48, and an axially outer end portion 64 which is distal to the central portion 48, the axially outer end portions 64 of the tubes 12 together forming the planar end face 56 of the tube bundle 14. The indentations 58 are preferably formed only in the outer end portions 64 and preferably do not extend into the inner end portions 62, which have a regular, hexagonal shape.

The void 60 is of a volume such that the amount of filler metal-forming material 61 introduced into void 60 is sufficient to form a sealed braze joint between the side surfaces 52. The filling of the voids and the formation of the brazed joints will be described in greater detail below.

Figure 6:
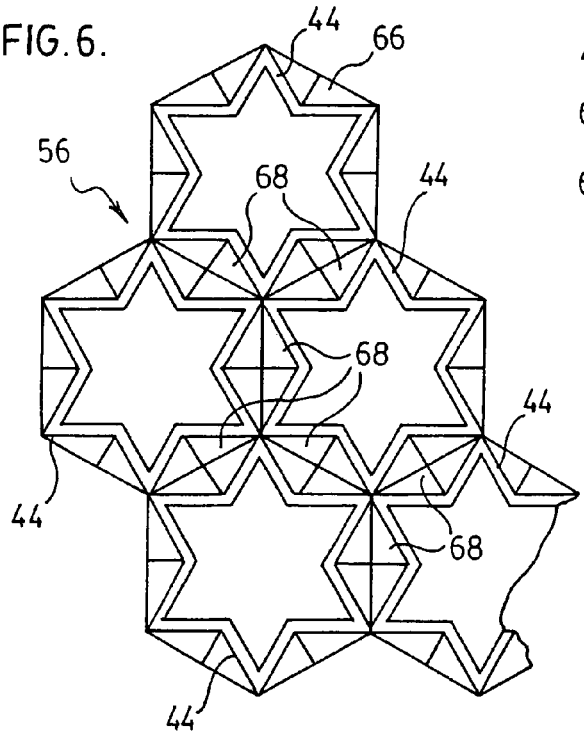
FIG. 6 illustrates a tube bundle in which a second preferred form of indentation is provided in the expanded tube end portions.
Figure 7:
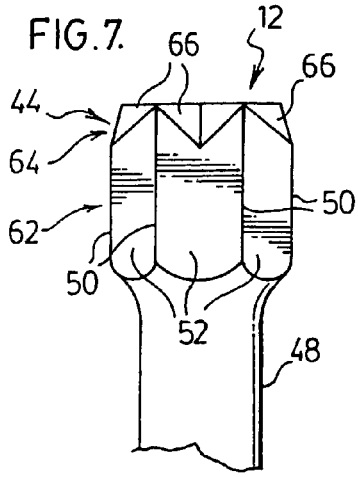
FIG. 7 is a side view of a tube having end portions indented as in FIG. 6.

FIG. 6 illustrates the end face 56 of a tube bundle 14 in which the individual tubes 12 have a second preferred form of indentation 66, and FIG. 7 is a side view of a tube 12 having indentations 66 in its side surfaces 52. Indentations 66 are in the form of angular V-shaped bends in the side surfaces 52, the bends extending to the corners 50. As in the preferred embodiment of FIGS. 4 and 5, the indentations 66 are preferably provided only in the outer end portion 64, such that the inner end portion 62 is of a substantially regular hexagonal shape. In the preferred embodiment of FIGS. 6 and 7, the indentations 66 of abutting side surfaces 52 communicate with one another to form voids 68 into which a filler metal-forming material can be introduced.

FIG. 8 illustrates the end face 56 of a tube bundle 14 in which the individual tubes 12 have a third preferred form of indentation 65, and FIG. 9 is a side view of a tube 12 having indentations 65 in its side surfaces 52. Indentation 65 is in the form of an axially extending concave rib and is provided at the corners 50. As in the preferred embodiment of FIGS. 4 and 5, indentations 65 are preferably provided only in the outer end portion 64, such that the inner end portion 62 is of a substantially regular hexagonal shape. In the preferred embodiment of FIGS. 8 and 9, the concave rib indentations 65 of three converging corners 50 combine to form a substantially cylindrical void 67 into which a filler metal-forming material 61 can be introduced from the end face 56 of the tube bundle 14.

Figure 10:
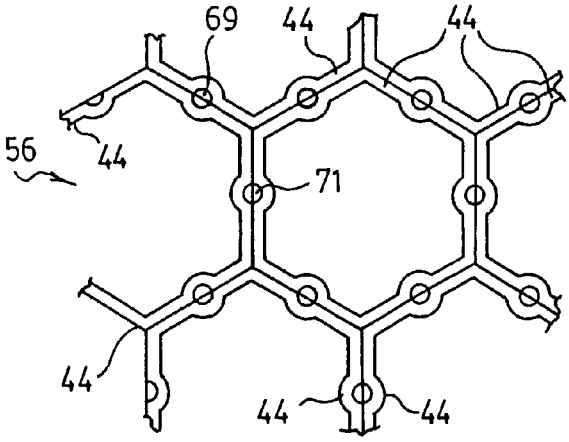
FIG. 10 illustrates a tube bundle in which a fourth preferred form of indentation is provided in the expanded tube end portions.
Figure 11:
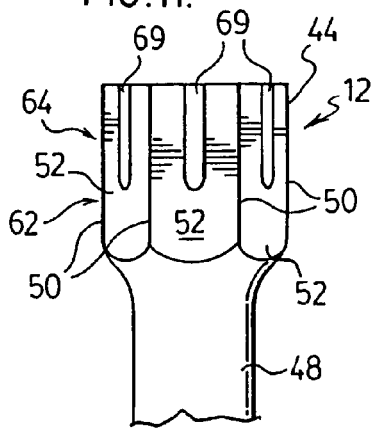
FIG. 11 is a side view of a tube having end portions indented as in FIG. 10.

FIG. 10 illustrates the end face 56 of a tube bundle 14 in which the individual tubes 12 have a fourth preferred form of indentation 69, and FIG. 11 is a side view of a tube 12 having indentations 69 in its side surfaces 52. Indentation 69 is in the form of an axially extending concave rib and is provided along the side surfaces 52, about midway between the corners 50. As in the preferred embodiment of FIGS. 4 and 5, indentations 69 are preferably provided only in the outer end portion 64, such that the inner end portion 62 is of a substantially regular hexagonal shape. The indentations 69 of abutting side surfaces 52 communicate with one another to form voids 71 into which a filler metal-forming material (not shown) can be introduced from the end face 56 of the tube bundle 14.

FIG. 12 illustrates the planar end face 56 of a tube bundle 14 in which the individual tubes 12 have a fifth preferred form of indentation 70, and FIG. 13 is a side view of a tube 12 having indentations 70 along its side surfaces. Indentation 70 is in the form of a regular, radially inward deformation of each of the side surfaces 52 along its entire length. As shown in FIG. 12, the indentation 70 is formed only in the outer end portion 64 of the tube end portion 44 or 46, thereby forming continuous voids 72 which are in communication with corresponding voids of adjacent abutting side surfaces 52.

Figure 14:
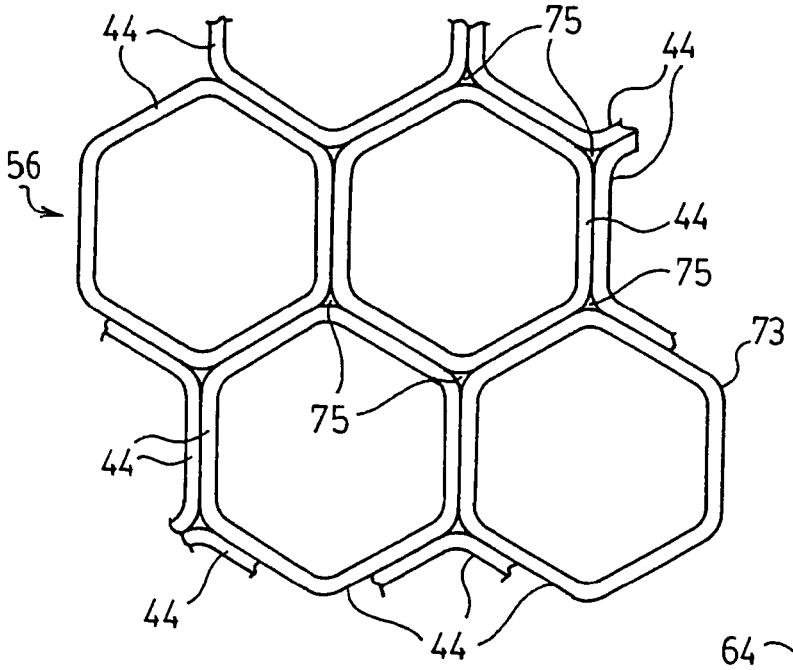
FIG. 14 illustrates a tube bundle in which a sixth preferred form of indentation is provided in the expanded tube end portions.
Figure 15:
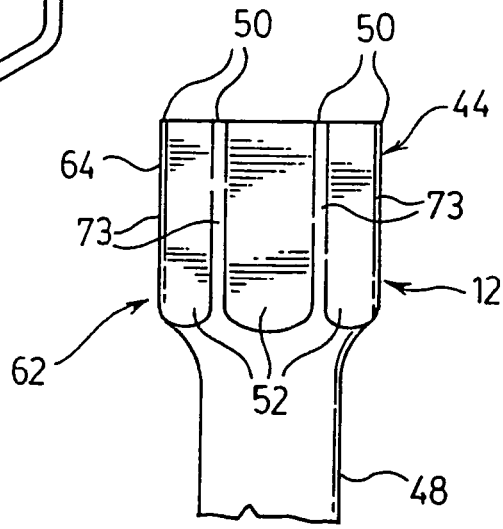
FIG. 15 is a side view of a tube having end portions indented as in FIG. 14.

FIG. 14 illustrates the planar end face 56 of a tube bundle 14 in which the individual tubes have a sixth preferred form of indentation 73, and FIG. 15 is a side view of a tube 12 having indentations 73 along its side surfaces. Indentations 73 are in the form of rounded corners 50 of the tube end portions 44. As shown in FIG. 15, the indentation 73 is formed throughout the inner 62 and outer 64 portions of the tube end portion 44. At the intersection of three corners 50, the indentations 73 combine to form a void 75 in which a filler metal-forming material can be received.

Although FIGS. 4 to 15 illustrate six preferred forms of indentation for forming voids between abutting side surfaces 52, it will be appreciated that numerous variations in the shapes of the indentations are possible, and are intended to be within the scope of the present invention. Furthermore, although the indentations are shown in the drawings as being in communication with one another to form the voids, it will be appreciated that this is not necessarily the case. For example, an indentation in one side surface 52 may simply form a void by abutting a flat portion of the side surface 52 of an adjacent tube end portion 44.

It will also be appreciated that the indentations and voids of FIGS. 4 to 15 are omitted from the remaining drawings for convenience. It will be appreciated that the side surfaces of tubes 12 shown in the remaining drawings may also be provided with indentations as described in FIGS. 4 to 15.

As shown in FIGS. 1 and 16 to 18, the tubes 12 are retained in tube bundle 14 by a ring header. Preferably, a ring header is provided at each end of the tube bundle 14.

Figure 16:
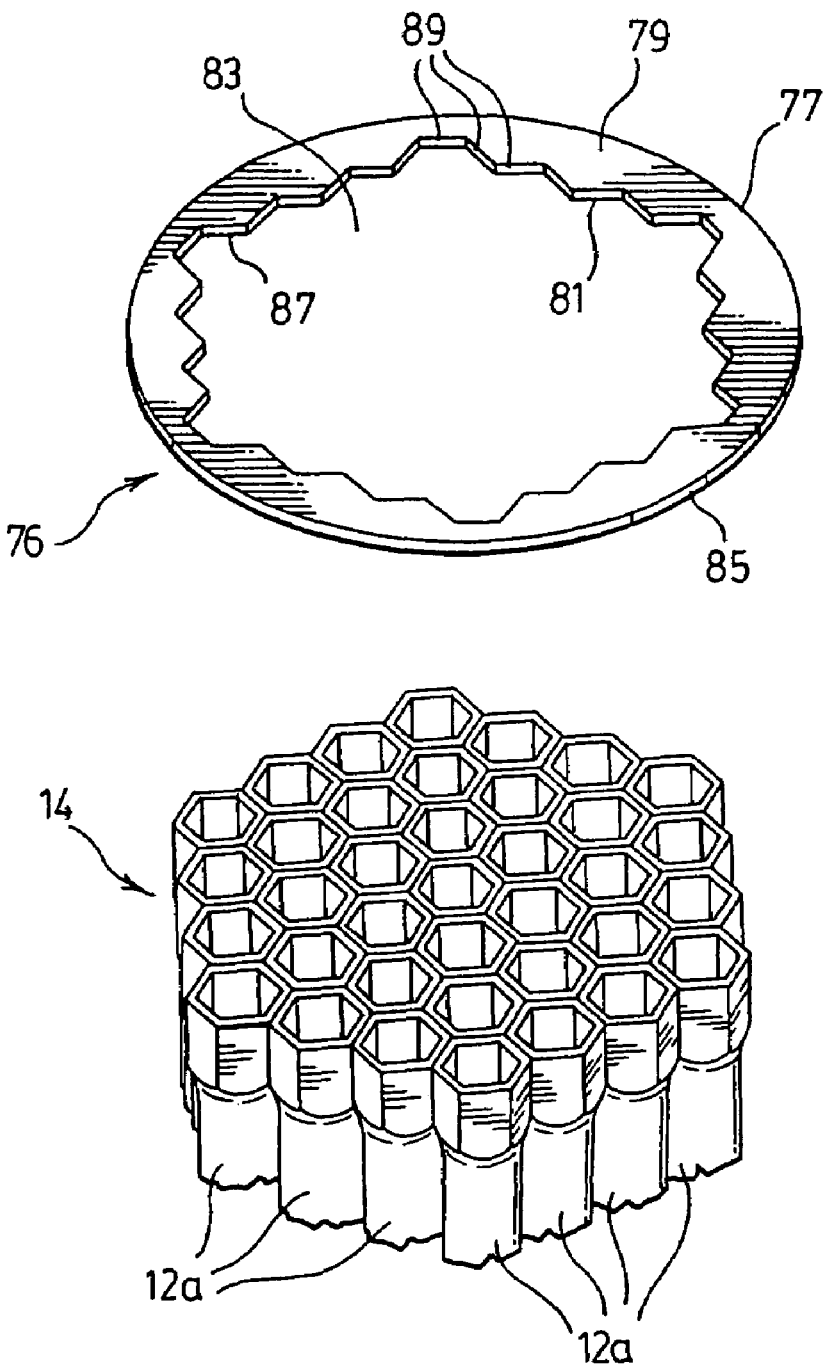
FIG. 16 is a perspective view of a first preferred header ring according to the invention, shown in spaced relation to a bundle of tubes having expanded, hexagonal end portions.

A first preferred ring header 76 is illustrated in FIGS. 1 and 16. Ring header 76 is annular in shape, comprising a radially-extending annular plate 77 having an upper surface 79, an opposite lower surface 81, a radially outer peripheral edge 85 and a radially inner peripheral edge 87 defining a central aperture 83. The inner edge 87 is adapted to form a sealed connection with the end portions 44,46 of the outer tubes 12*a* of tube bundle 14. The inner edge 87 is therefore multi-faceted and comprises a plurality of bonding surfaces 89 (only some of which are labelled) along which the inner edge 87 is connected to the tube end portions 44,46. The sealed connection between the inner edge 87 and the tube bundle 14 prevents axial flow of heat exchange fluid between the bonding surfaces 89 of inner edge 87 and the radially outward facing side surfaces of the outer tubes 12*a*.

The outer edge 85 of header ring 76 is adapted to form a sealed connection with the inner surface of the heat exchanger housing so as to prevent axial flow of heat exchange fluid therebetween. Where the housing comprises a cylindrical housing 16, the outer edge 85 of header ring 76 is circular and has a diameter slightly smaller than that of the housing 16. It will be appreciated that the separation between the inner edge 87 and outer edge 85 of header ring 76 is preferably minimized, while preserving the structural integrity of the header ring 76. This minimizes the gap between the outer tubes 12*a* and the wall of the housing 16, thereby encouraging fluid flow through the interstitial spaces 54 between tubes 12 and enhancing efficiency of the heat exchanger. It will be appreciated that use of header ring 76 avoids the need to shape the housing 16 to conform to the irregularly-shaped tube bundle, as in the above-mentioned patent to Damsohn et al., thereby simplifying the manufacturing process and providing obvious economic benefits.

It will also be appreciated that the header ring according to the invention can be modified by providing it with an outer and/or an inner axially-extending sidewall to increase the area of the surfaces along which it is connected to the tube bundle 14 and/or the housing 16. FIGS. 17 and 18 illustrate such a header ring 90 having a generally U-shaped axial cross-section, comprising a radially extending annular plate portion 92 similar in shape and size to the plate 77 of flat header ring 76. Extending axially from an inner peripheral edge of plate portion 92 is an inner sidewall 94 which, like inner edge 87 of header ring 76, is adapted to form a sealed connection with the end portions 44,46 of the outer tubes 12*a* of tube bundle 14. The inner sidewall 94 is therefore multi-faceted and comprises a plurality of bonding surfaces 95 (only some of which are labelled) along which the inner sidewall 94 is connected to the tube end portions 44,46, and defines a central aperture 96 of the header ring 90. The sealed connection between the inner sidewall 94 and the tube bundle 14 prevents axial flow of heat exchange fluid between the bonding surfaces 95 of inner sidewall 94 and the radially outward facing side surfaces of the outertubes 12*a*.

The header ring 90 further comprises an outer sidewall 98 which extends axially from an outer peripheral edge of plate portion 92. Like the outer edge 85 of flat header ring 76, the outer sidewall 98 is adapted to form a sealed connection with the inner surface of the heat exchanger housing so as to prevent axial flow of heat exchange fluid therebetween. Where the housing comprises a cylindrical housing 16, the outer sidewall 98 is circular and has a diameter slightly smaller than that of the housing 16. The radial distance between the sidewalls 94 and 98 is preferably minimized for the reasons discussed above.

It will be appreciated that there are numerous other possible structures for header rings according to the invention. Instead of a U-shaped cross-section as in FIG. 17, the header ring may instead have an L-shaped cross section by providing only an outer sidewall 98 or an inner sidewall 94. In another alternative construction, the header ring may have the inner and outer sidewalls 94, 98 extending in opposite directions to one another. Furthermore, the open side of U-shaped header ring 90 may face toward the interior of the housing 16 (not shown) or away from the interior of the housing 16, as shown in FIG. 18. In yet another alternate embodiment, the header ring is flat, similar in appearance to header ring 76, but is substantially thicker so as to have inner and outer peripheral edges similar in area to the inner and outer sidewalls 94, 98 of the U-shaped header ring 90.

In FIG. 18, the inlet cap 28 forms a lap joint with the outer surface of the housing 16. It will also be appreciated that the construction of heat exchanger 10 is illustrative only, and that the construction could vary without departing from the scope of the present invention. For example, heat exchanger 10 could also be constructed such that the housing 16 fits over the header ring 76 and the cylindrical end of the inlet cap 28. In such a construction, lap joints would be formed between inlet cap 28 and the outer side wall 98 of header ring 76, and between the inlet cap 28 and the inner surface of housing 16.

Although not shown in the drawings, it will be appreciated that the inner and/or outer peripheral edges 87 and 85 of ring header 76, and the inner and outer sidewalls 94, 98 of header ring 90, may preferably be provided with indentations such as those described above in relation to FIGS. 4 to 15, such that voids may be formed between the axial surfaces of header rings 76 and 90 and the side surfaces 52 of the tubes 12 in tube bundle 14.

The following is a description of one preferred method for manufacturing a heat exchanger according to the present invention in which the components of the heat exchanger are joined by brazing. First, a plurality of heat exchanger tubes are provided, the tubes being as described above with reference to FIG. 2, and having indentations in their end portions as described above with reference to FIGS. 4 to 15. The tubes 12 are formed into a tube bundle 14 as shown in FIG. 3, with the end portions 44, 46 of the tubes 12 being retained in position by a ring header as described above. The tube bundle may also comprise one or more baffle plates, such as plates 42 described above.

Next, the voids between the facing pairs of side surfaces 52 are at least partially filled with a filler metal-forming material, the amount of the filler metal-forming material being sufficient to form a sealed braze joint between the facing pair of side surfaces. The tube bundle 14 is then assembled with the remaining components of the heat exchanger, such as the housing, and the inlet and outlet ports. Next, the heat exchanger assembly is heated in a brazing oven to a sufficient temperature and for a sufficient time to cause the filler metal-forming material to liquefy and be drawn by capillary action into the joints between the side surfaces 52 of adjacent tubes 12 and into the joints between the side surfaces 52 of tubes 12 and the surrounding header ring, inlet cap 28 or outlet cap 36. Cooling the brazed heat exchanger assembly results in solidification of the filler metal, thereby forming sealed lap joints between adjacent tubes 12 and between the tube bundle 14 and the header ring 76 or caps 28,36. Similarly, braze joints are formed between the remaining components of the heat exchanger.

A number of different types of filler metal-forming materials are suitable for use in the present invention, including powdered filler metal compositions, filler metal-containing pastes and solid filler metal compositions.

It will be appreciated that the components of the heat exchanger according to the invention are not necessarily joined by brazing, but can be joined by other means. For example, laser welding can be used, requiring no filler metal and therefore no indentations in the tube end portions. It will also be appreciated that indentations are not necessarily required in brazed heat exchangers. As mentioned above, sufficient quantities of filler metal-forming materials can be applied by staggering the tube ends.

A number of preferred baffle constructions for heat exchangers according to the invention will now be described below with reference to FIGS. 19 to 26. By way of background, a conventional tube bundle having a perforated or annular baffle plate is typically assembled by inserting the tube ends through the perforations in the baffle plate, or through the central aperture of an annular baffle plate, and then sliding the baffle plate along the tubes to its desired position. However, in a tube bundle according to the invention having tubes with expanded ends, this method of assembling the tube bundle is not possible since the tube ends cannot fit through the perforations in a conventional perforated baffle plate or through the central aperture of an annular baffle plate. The following discussion, along with FIGS. 19 to 26, describes baffle plates, or functional equivalents thereof, for use in the heat exchangers according to the invention having bundles of tubes with expanded, shaped ends.

Figures 19A, 19B:
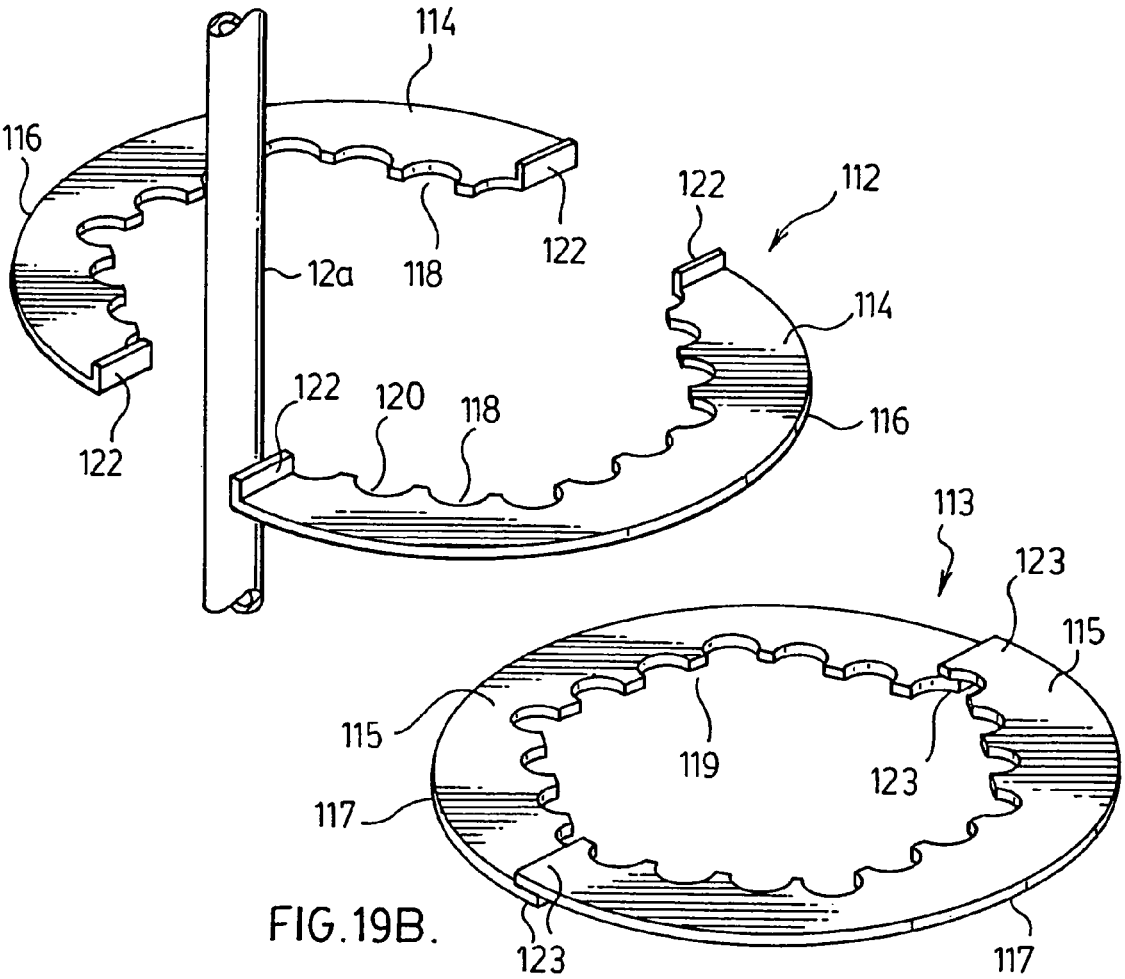
FIGS. 19A and 19B are perspective views of segmented annular baffle plates according to the invention.

Possible constructions of annular baffle plates according to the invention are the segmented, annular baffle plates 112, 113 shown in FIGS. 19A and 19B, respectively. Segmented baffle plates 112, 113 are adapted for use with tube bundles 14 as described above which are comprised of a plurality of outer tubes 12*a* and a plurality of inner tubes 12*b*. It will be appreciated that the annular baffles 42 shown in FIGS. 1 and 3 may preferably have either the construction shown in FIG. 19A or that shown in FIG. 19B.

Baffle plate 112 comprises two segments 114 which are preferably identical to one another. The segments are generally semi-circular in shape, having an arcuate outer peripheral edge 116 adapted to form a butt joint with the housing (not shown of the heat exchanger). It will be appreciated that segmented baffle plate may comprise more than two segments, for example three or four segments may be preferred in some embodiments. Each segment 114 has an inner peripheral edge 118 so that when the segmented baffle plate 112 is assembled, a central aperture is formed through which the first heat exchange fluid is guided and through which the inner tubes 12*b* of tube bundle 14 extend. The inner peripheral edge 118 has a scalloped appearance, comprising a plurality of concave sections 120, each of which mates with an outer surface of one of the outer heat exchange tubes 12*a*, such that a brazed butt joint may preferably be formed between the outer surfaces of tubes 12*a* and the concave sections 120. While not necessary, the concave sections 120 may be of sufficient circumferential length such that they form a snap fit, or interference fit, with the tubes 12*a*, thereby facilitating assembly of the tube bundle 14.

Each of the segments 114 is provided at its ends with axially extending end flanges 122 extending at substantially right angles to the radially extending portions of segments 114. When the segments 114 are brought together against tubes 12*a* during assembly of baffle plate 112, the end flanges 122 of adjacent segments 114 abut one another, thereby providing sufficient surface area to form brazed lap joints between the end flanges 122 of the segments 114.

It will be appreciated that the outer peripheral edges 116 and/or the inner peripheral edges 118 of segments 114 may also be provided with axially extending flanges (not shown) extending along at least a part of their circumferential length, so as to provide surface areas along which brazed lap joints can be formed with the housing and/or the outer tubes 12*a*, respectively.

The segmented baffle plate 113 of FIG. 19B is similar, comprising two segments 115 which are preferably identical to one another. The segments are generally semi-circular in shape, having an arcuate outer peripheral edge 117 adapted to form a butt joint with the housing (not shown of the heat exchanger). Each segment 115 has a scalloped inner peripheral edge 119 to form a central aperture and to mate with outer surfaces of the outer heat exchange tubes 12*a*. The distance between the ends of each segment 115 along the baffle is greater than 180 degrees, so that the ends of the segments form overlapping, radially extending portions 123 which overly one another to provide sufficient surface area for formation of a lap joint.

Figure 20:
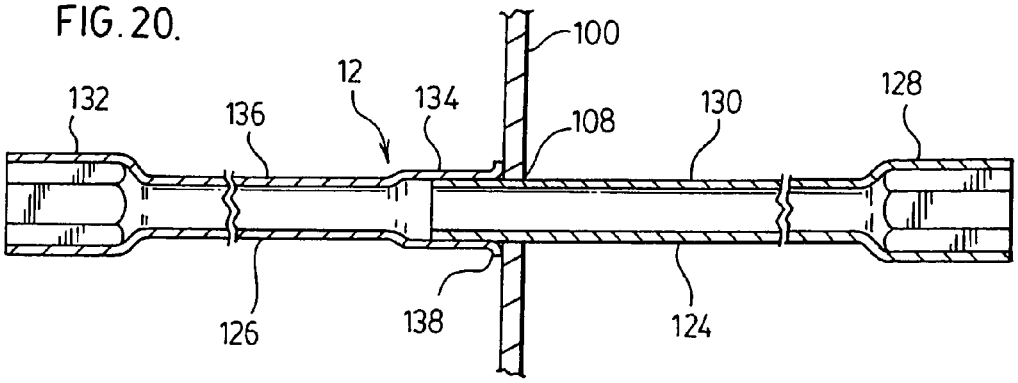
FIG. 20 is a cross-sectional side view showing a joint between a first preferred segmented tube according to the invention with a perforated baffle plate.
Figure 21:
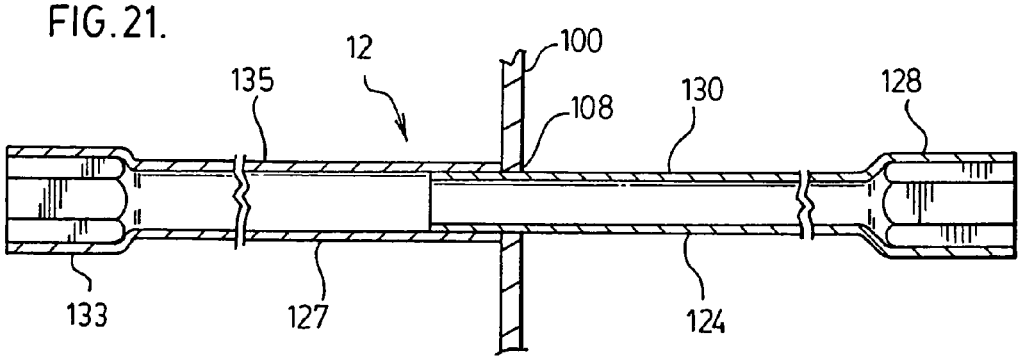
FIG. 21 is a cross-sectional side view showing a joint between a second preferred segmented tube according to the invention with a perforated baffle plate.

FIGS. 20 and 21 illustrate preferred baffle/tube arrangements which utilize a conventional perforated baffle plate 100 having a plurality of perforations 108 sized to closely receive tubes 12. In the embodiment of FIG. 20, the heat exchanger tubes 12 extending through the perforations 108 of baffle plate 100 are segmented, with each tube 12 comprising a pair of tube segments 124 and 126. The first segment 124 of tube 12 comprises a tube end portion 128 which is expanded and provided with a polygonal shape, preferably a hexagonal shape as in tube end portions 44, 46 described above. The tube end portion 128 is greater in diameter than the perforations 108 in the baffle plate 100. The first tube segment 124 further comprises a cylindrical portion 130 of constant, circular cross section, the cylindrical portion 130 having a diameter such that it is closely received in perforation 108. During assembly of a tube bundle 14, the cylindrical portion 130 of first tube segment 124 is inserted through the perforation 108.

The second segment 126 of tube 12 comprises a first end portion 132 which is expanded and provided with a polygonal shape, preferably a hexagonal shape as in tube end portions 44, 46 and 128. The tube end portion 132 is greater in diameter than the perforations 108 in the baffle plate 100. The second segment 126 also comprises a second end portion 134 at its opposite end, and a central portion 136 connecting the first and second end portions 132,134. The central portion 136 is shown in FIG. 20 as having a circular cross section and being smaller in diameter than the end portions 132 and 134.

The second end portion 134 of tube segment 126 is expanded to a cylindrical shape with a slightly greater diameter than the cylindrical portion 130 of tube segment 124, such that the cylindrical portion 130 of tube segment 124 can be closely received inside, and brazed to, the second end portion 134 of tube segment 126. Furthermore, the diameter of the second end portion 134 of tube segment 126 is preferably greater than that of perforations 108 of baffle plate 100, thereby positioning the baffle plate 100 relative to the tube segments 124,126. The second end portion 134 of tube segment 126 may preferably be brazed to the baffle plate 100, and may preferably be provided with a radially extending flange 138 to increase the brazing surface between the end portion 134 and the baffle plate 100.

It will also be appreciated that tube segments 124 and 126 may be formed from tubes of different diameters, as shown in FIG. 21. This somewhat simplifies the construction of the tubes and the processes by which they are formed. The embodiment of FIG. 21 utilizes a tube 12 comprising a first segment 124, as described above in connection with FIG. 20, and a second segment 127. The second segment 127 is formed from a cylindrical tube having an inner diameter slightly greater than the outer diameter of the tube from which segment 124 is formed, and which has an outer diameter greater than the diameter of perforations 108. Second segment 127 comprises a first end portion 133 which is expanded and provided with a polygonal shape, preferably a hexagonal shape identical in cross-sectional shape and area to the end portion 128 of first segment 124. The cylindrical portion 130 of first segment 124 is closely received inside the cylindrical portion 135 of the second segment 127.

Figure 22:
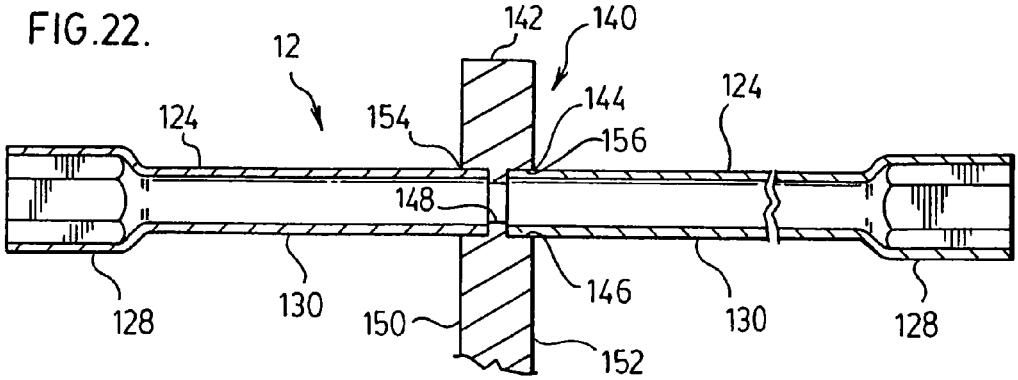
FIG. 22 is a cross-sectional side view showing a joint between a segmented tube and a second preferred baffle according to the invention.

FIG. 22 shows an alternate tube/baffle connection in which the tubes 12 each comprise two segments 124, each of which may preferably be identical to the first tube segments 124 shown in FIGS. 20 and 21, having an expanded polygonal tube end portion 128 and a cylindrical portion 130 of smaller diameter. Rather than a baffle plate 100, the embodiment of FIG. 22 utilizes a baffle plate 140 which is preferably of the same general configuration as baffle plate 100, having a generally circular outer peripheral edge 142, a generally circular inner peripheral edge (not shown) defining a central aperture (not shown), and a plurality of perforations 144, each having an inner peripheral edge 146.

Baffle plate 140 differs from baffle plate 100 substantially only in that the baffle plate 140 is somewhat thicker than baffle plate 100, and in that the peripheral edges 146 of perforations 144 are provided with flanges 148 extending radially inwardly toward the centres of perforations 144. The flanges 148 are preferably centrally located between the radial faces 150 and 152 of baffle plate 140 so that each perforation 144 defines a pair of axially extending cylindrical sleeves 154 and 156, each of which closely receives the cylindrical portion 130 of one of the tube segments 124, with the flange 148 acting as a stop abutting against the ends of cylindrical portions 130. As shown in FIG. 22, sleeve 154 extends axially from the radial face 150 of baffle plate 140 to the flange 148, and sleeve 156 extends axially from the radial face 152 of baffle plate 140 to the flange 148. The tube/baffle connection shown in FIG. 22 is advantageous in that it utilizes identical tube segments 124, and that it provides for lap joints between the tube segments 130 and baffle 140, as well as between the outer edge 142 of baffle 140 and the inner surface of the housing (not shown).

It will be appreciated that the tube/baffle connection illustrated in FIGS. 20 to 22 are used only for tubes 12 which pass through perforations of the baffle plates 100 or 140. The tubes 12 which do not pass through the perforations will preferably not be segmented, and are preferably identical to the tubes 12 of heat exchanger 10 described above.

Figure 23:
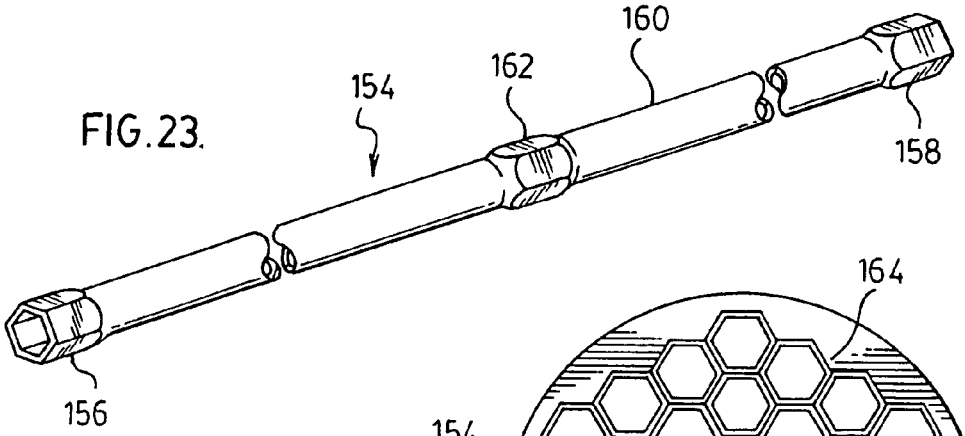
FIG. 23 illustrates a tube according to the invention having an expanded, polygonal central section.

FIG. 23 illustrates a preferred form of heat exchanger tube 154 for use in a preferred embodiment of the invention which permits the elimination of baffle plates in the tube bundle heat exchangers according to the invention. The tube 154 comprises a first end portion 156, a second end portion 158 and a central portion 160 extending between the two end portions 156,158. The first and second end portions 156,158 are expanded and have a polygonal cross section, and are preferably identical to the tube end portions 44,46 of tubes 12 described above. The central portion 160 is generally cylindrical and of smaller diameter along most of its length than the end portions 156,158, and is preferably identical in cross-sectional shape and size to the central portion 48 of tubes 12 described above, with the exception that it is provided with one or more expanded portions 162. The expanded portions 162 are of greater cross-sectional area than the remainder of central portion 160 and are preferably identical in cross-sectional shape and size to the end portions 156,158.

Figure 24:
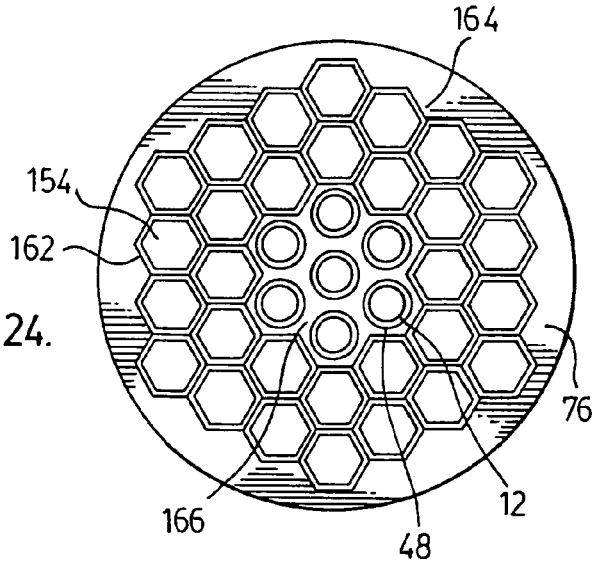
FIG. 24 is a radial cross-section through a tube bundle comprising a number of tubes as shown in FIG. 21.

FIG. 24 is a cross sectional view of a heat exchanger including a tube bundle 164 having a plurality of tubes 154 and a plurality of tubes 12, the cross section being taken in a radial plane extending through the expanded portions 162 of tubes 154. The tubes 154 and 12 are arranged in a bundle 164 with the tubes 154 being arranged in a radially outwardly lying portion of the tube bundle 164, and the tubes 12 defining a radially inward portion of the tube bundle 164. The expanded portions 162 of tubes 154 nest with one another in the same manner as the end portions 44,46,156 and 158, such that the sides of the expanded portions 162 abut one another and are adapted to be sealed together, for example, by brazing. The tubes 12, on the other hand, have central portions 48 which are of smaller, circular cross sectional area such that interstitial spaces 166 are formed between the central portions 48 of tubes 12, and between tubes 12 and the surrounding tubes 154. A ring header 76 as described above preferably surrounds the outer periphery of the tube bundle, serving to seal the space between the tube bundle 164 and the wall of housing 16 (not shown). Therefore, it can be seen that the arrangement of tubes 154 and 12 shown in FIG. 24 serves as a baffle, and will direct flow of the first heat exchange fluid away from the walls of housing 16 and through the central portion of tube bundle 164 defined by the interstitial spaces 166 between the tubes 12, 154. Thus, the arrangement shown in FIG. 24 permits the elimination of baffle plates.

Figure 25:
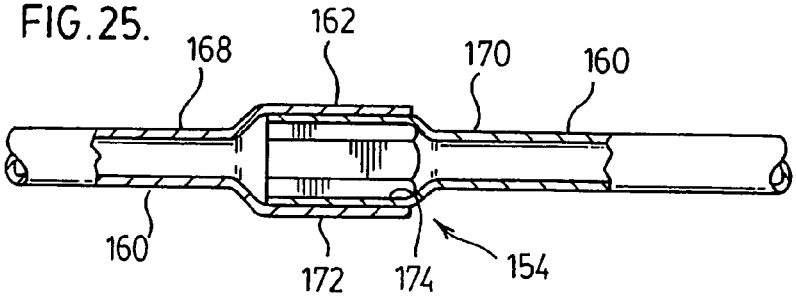
FIG. 25 is a cross-sectional side view illustrating a preferred means for forming an expanded central section from a pair of tube segments.
Figure 26:
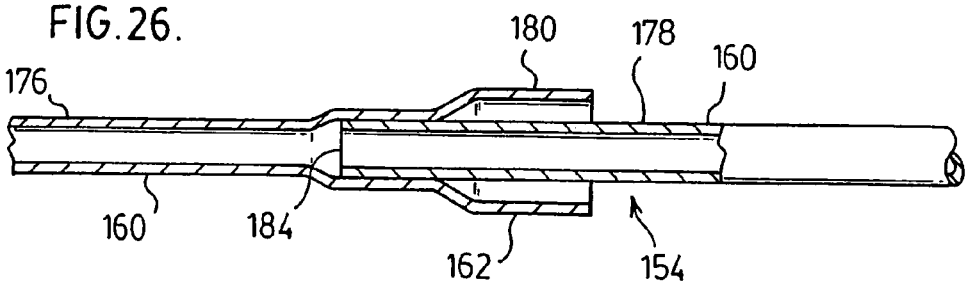
FIG. 26 is a cross-sectional side view illustrating another preferred means for forming an expanded central section from a pair of tube segments.

While it is possible to expand and shape a tube between its ends to form an expanded portion 162, it may be preferred to form the tubes 154 from two or more segments, in which the expanded portions 162 are formed at the locations where the segments are connected. FIGS. 25 and 26 illustrate two possible ways in which this can be accomplished.

A preferred connection between two segments 168, 170 of a tube 154 is illustrated in FIG. 25. As mentioned above, the tube 154 has a central portion 160 in which one or more expanded portions are provided. In the embodiment of FIG. 25, the first tube segment 168 has an expanded end portion 172 which preferably has a cross-sectional shape and size which is identical to that of the tube end portions 156,158 shown in FIG. 23. In the preferred embodiment shown in the drawings, the cross sectional shape of expanded end portion is hexagonal. The second tube segment 170 has an expanded end portion 174 which has the same cross sectional shape as the expanded end portion 172 of first segment 168, but which is of slightly smaller size so as to be snugly nested inside the expanded end portion 172. A braze joint is preferably formed along the overlapping surfaces of the expanded end portions 172, 174.

FIG. 26 illustrates a second preferred connection between two segments 176, 178 of a tube 154. As in FIGS. 24 and 25, the tube 154 has a central portion 160 in which one or more expanded portions 162 are provided. In the embodiment of FIG. 26, the first tube segment 176 has an expanded end portion 180 which preferably has a cross-sectional shape and size which is identical to that of the tube end portions 156,158 shown in FIG. 23. In the preferred embodiment shown in the drawings, the cross sectional shape of expanded end portion 180 is hexagonal. The first tube segment 176 also has an intermediate expanded portion 182 having an inside diameter less than that of the expanded end portion and slightly greater than the remainder of the central portion 160. The second tube segment 178 has an end portion 184 which is preferably of the same cross-sectional shape and size as the remainder of central portion 160. Thus, when the two segments 176,178 are assembled, the end portion 184 of the second tube segment 178 is closely received inside the intermediate portion 182 of the first tube segment 176. A braze joint is preferably formed along the overlapping surfaces of the end portion 184 of the second segment 178 and the intermediate portion 184 of the first segment 176.

It will be appreciated that there are numerous other ways for forming an expanded portion of tube 154 which are within the scope of the present invention.

It will also be provided that one or more axially spaced expanded portions 162 may be provided on the same tube 154, and/or that two or more axially spaced "baffle" arrangements formed by expanded portions 162 can be provided along the length of the heat exchanger. Thus, the "baffles" formed by expanded portions 162 can provide a cascading flow of fluid through the housing, with the flow of fluid alternately being directed toward and away from the housing, so as to maximize heat exchange with the fluid flowing through the tubes.

Although the invention has been described in connection with a tube bundle heat exchanger having an annular header ring, it will be appreciated that the invention also includes heat exchangers in which headers are eliminated and in which the heat exchanger shell is shaped so as to seal directly against the expanded end portions of the outer tubes in the tube bundle.

Although the invention has been described in relation to certain preferred embodiments, it is not intended to be limited thereto. Rather, the invention includes all embodiments which may fall within the scope of the following claims.

What is claimed is:

1. A heat exchanger comprising a plurality of tubes extending in parallel relation to one another and defining a tube axis, each of said tubes comprising:

a pair of open ends, a tube wall extending between the ends and defining a hollow interior, a portion having an enlarged cross-sectional area and a portion having a relatively smaller cross-sectional area, both the enlarged portion and the smaller portion extending parallel to the tube axis;

the enlarged portion of each of the tubes having a cross-sectional shape comprising a plurality of corners and a plurality of side surfaces extending between the corners, the side surfaces being generally parallel to the tube axis;

the tubes being arranged as a tube bundle in which a first plurality of said tubes comprise inner tubes and a second plurality of said tubes comprise outer tubes, the outer tubes being located on a periphery of the tube bundle, wherein the enlarged portion of each of the tubes abuts the enlarged portion of at least one other tube, said enlarged portions being in abutment with one another along their side surfaces, with sealed connections being provided between abutting pairs of said side surfaces to prevent axial flow of a fluid between the abutting side surfaces, and with interstitial spaces being formed between the smaller portions of adjacent tubes;

the enlarged portion of each of the inner tubes abutting the enlarged portions of adjacent tubes along all of its side surfaces;

at least one side surface of the enlarged portion of each outer tube facing generally radially outwardly and not being connected to the side surface of the enlarged portion of an adjacent tube, said radially outwardly facing surfaces defining said periphery of the tube bundle;

wherein the enlarged portions of at least some of the tubes are provided with indentations, the indentations forming voids between the abutting enlarged portions of adjacent tubes.

2. The heat exchanger of claim 1, further comprising an annular header ring extending about the periphery of the tube bundle and being connected to the enlarged portions of the outer tubes.

3. The heat exchanger of claim 2, wherein the header ring comprises a radially extending annular plate, the header ring having a radially outer peripheral edge and a radially inner peripheral edge, the inner edge being shaped to closely follow the periphery of the tube bundle, and comprising a plurality of surfaces, each of which is connected to one of the radially outwardly facing side surfaces of the enlarged portions of the outer tubes such that axial flow of said fluid is prevented between the surfaces of the inner edge and the radially outward facing side surfaces of the outer tubes.

4. The heat exchanger of claim 3, wherein the inner peripheral edge of the header ring is provided with an inner axially-extending sidewall, the inner sidewall being joined to annular plate along the inner peripheral edge.

5. The heat exchanger of claim 4, wherein each of the surfaces of the inner sidewall is substantially coextensive with one of the outwardly facing side surfaces of the outer tubes.

6. The heat exchanger of claim 2, wherein the outer peripheral edge of the header ring is provided with an outer axially-extending sidewall, the outer sidewall being joined to the annular plate along the outer peripheral edge.

7. The heat exchanger of claim 2, further comprising an axially-extending housing at least partially surrounding the tubes, the housing having a cylindrical inner surface, wherein the outer edge of the header ring is cylindrical and is connected in sealed relation to the inner surface of the housing.

8. The heat exchanger of claim 1, wherein the enlarged portion of each of the tubes is located at one of the ends.

9. The heat exchanger of claim 1, wherein the smaller portion of each of the tubes is located at one of the ends.

10. The heat exchanger of claim 2, wherein the smaller portion of each of the tubes is located intermediate the ends; wherein each of the tubes includes two of said enlarged portions, the enlarged portions being located at the ends of the tubes; and wherein said heat exchanger includes two of said header rings, each of the header rings being connected to the enlarged portions at the ends of the outer tubes.

11. The heat exchanger of claim 10, wherein at least some of the tubes further comprise:

a portion of enlarged diameter intermediate the ends of the tubes, the enlarged intermediate portion having the same cross-sectional shape and size as the enlarged portions at the ends of the tubes, and comprising a plurality of corners and a plurality of side surfaces extending between the corners, the side surfaces being generally parallel to the tube axis.

12. The heat exchanger of claim 11, wherein the enlarged intermediate portion of each tube abuts the enlarged intermediate portion of at least one adjacent tube, the enlarged intermediate portions of the adjacent tubes being in abutment with one another along their side surfaces, wherein sealed connections are provided between abutting pairs of said side surfaces of the enlarged intermediate portions, said sealed connections preventing axial flow of a fluid between the abutting side surfaces of said enlarged intermediate portions.

13. The heat exchanger of claim 1, wherein said cross-sectional shape comprises a generally polygonal cross-sectional shape.

14. The heat exchanger of claim 13, wherein said polygonal cross-sectional shape is selected from the group comprising triangular, square, rectangular, pentagonal, hexagonal, heptagonal and octagonal.

15. The heat exchanger of claim 14, wherein said polygonal cross-sectional shape is hexagonal.

16. The heat exchanger of claim 1, wherein the smaller portion of each of the tubes has a circular cross section along part or all of its length.

17. The heat exchanger of claim 1, wherein the tubes are arranged such that the side surfaces of each said abutting pair are substantially coextensive.

18. The heat exchanger of claim 1, wherein said indentations are formed in the side surfaces of the enlarged portions, between the corners.

19. The heat exchanger of claim 1, wherein at least some of the voids formed between the abutting pairs of enlarged portions comprise a plurality of said indentations in communication with one another.

20. The heat exchanger of claim 1, wherein the enlarged portions at the ends of the tubes each have an axially inner portion proximate the smaller portion of the tube and an axially outer portion distal to the smaller portion, the indentations being provided in the axially outer portion.

21. The heat exchanger of claim 20, wherein the axial inner portions of the tubes have a regular polygonal shape.

22. The heat exchanger of claim 1, further comprising an axially-extending housing at least partially surrounding the tubes, the housing having a first fluid inlet and a first fluid outlet, both the first fluid inlet and the first fluid outlet being in fluid communication with the interstitial spaces between the smaller portions of the tubes.

23. The heat exchanger of claim 22, further comprising a second fluid inlet provided at a first end of the heat exchanger and a second fluid outlet provided at a second end of the heat exchanger, the second fluid inlet and the second fluid outlet being in fluid communication with the hollow interiors of the tubes.

24. The heat exchanger of claim 20, wherein the indentations of the side surfaces comprise a regular, radially inward deformation of each of the side surfaces along its entire length.

25. The heat exchanger of claim 18, wherein the side surfaces are deformed concavely between the corners such that the deformations are arc-shaped.

26. The heat exchanger of claim 18, wherein the indentations are in the form of angular V-shaped bends in the side surfaces.

27. A heat exchanger comprising a plurality of tubes extending in parallel relation to one another and defining a tube axis, each of said tubes comprising:

a pair of open ends, a tube wall extending between the ends and defining a hollow interior, a portion having an enlarged cross-sectional area and a portion having a relatively smaller cross-sectional area, both the enlarged portion and the smaller portion extending parallel to the tube axis;

the enlarged portion of each of the tubes having a cross-sectional shape comprising a plurality of corners and a plurality of side surfaces extending between the corners, the side surfaces being generally parallel to the tube axis;

the tubes being affanged as a tube bundle in which a first plurality of said tubes comprise inner tubes and a second plurality of said tubes comprise outer tubes, the outer tubes being located on a periphery of the tube bundle, wherein the enlarged portion of each of the tubes abuts the enlarged portion of at least one other tube, said enlarged portions being in abutment with one another along their side surfaces, with sealed connections being provided between abutting pairs of said side surfaces to prevent axial flow of a fluid between the abutting side surfaces, and with interstitial spaces being formed between the smaller portions of adjacent tubes;

the enlarged portion of each of the inner tubes abutting the enlarged portions of adjacent tubes along all of its side surfaces;

at least one side surface of the enlarged portion of each outer tube facing generally radially outwardly and not being connected to the side surface of the enlarged portion of an adjacent tube, said radially outwardly facing surfaces defining said periphery of the tube bundle;

wherein the heat exchanger further comprises a radially extending baffle plate for directing flow of a heat exchange fluid, said baffle plate being located between the ends of the tubes and having a plurality of perforations, each of which closely receives the smaller portion of one of the tubes;

wherein each of the tubes extending through one of the perforations is comprised of first and second tube segments which are connected by a connection, the connection being located proximate the baffle plate.

28. The heat exchanger of claim 27, wherein the first tube segment has an end portion which is inserted through the baffle plate and extends into an end portion of the second tube segment.

29. The heat exchanger of claim 27, wherein the baffle plate extends about the periphery of the tube bundle and has a central aperture to direct flow of said heat exchange fluid radially inwardly of the periphery of the tube bundle.

30. The heat exchanger of claim 29, wherein the baffle plate comprises two or more segments, each of which extends partially around the periphery of the tube bundle.

31. The heat exchanger of claim 30, wherein the segments of the baffle plate have axially-extending end surfaces at which they are connected together.

32. The heat exchanger of claim 30, wherein the segments of the baffle plate have overlapping, radially-extending surfaces at which they are connected together.

33. The heat exchanger of claim 11, wherein each of the outer tubes of the tube bundles is provided with one of said enlarged intermediate portions and wherein said interstitial spaces are provided between at least some of the inner tubes, such that flow of the fluid is directed radially inwardly.

34. The heat exchanger of claim 11, wherein at least some of the inner tubes are provided with one of said enlarged intermediate portions and wherein said interstitial spaces are provided between at least some of the outer tubes, such that flow of the fluid is directed radially outwardly.

35. The heat exchanger of claim 28, wherein the end portion of the second tube segment has a diameter which is slightly greater than a diameter of the end portion of the first tube segment, such that the end portion of the first tube segment is closely received inside the end portion of the second tube segment.

36. The heat exchanger of claim 35, wherein the diameter of the end portion of the second tube segment is greater than a diameter of the perforations in the baffle plate.

37. The heat exchanger of claim 36, wherein the end portion of the second tube segment is provided with a radially extending flange through which it is in contact with the baffle plate.

38. The heat exchanger of claim 27, wherein the first and second tube segments have end portions which are of the same diameter, and wherein the perforations of the baffle plate define axially extending sleeves into which the end portions of the tube segments are closely received.

39. The heat exchanger of claim 38, wherein each of the perforations is provided with a radial flange which is centrally located between radial faces of the baffle plate, and wherein the flanges abut against the end portions of the first and second tube segments.

* * * * *

UNITED STATES PATENT AND TRADEMARK OFFICE

CERTIFICATE OF CORRECTION

PATENT NO. : 7,240,723 B2
APPLICATION NO. : 10/778571
DATED : July 10, 2007
INVENTOR(S) : Wu et al.

It is certified that error appears in the above-identified patent and that said Letters Patent is hereby corrected as shown below:

Column 18, line 18, please delete “affanged” and insert --arranged--.

Signed and Sealed this

Sixth Day of November, 2007

JON W. DUDAS
*Director of the United States Patent and Trademark Office*